US006457308B1

(12) United States Patent
Lin et al.

(10) Patent No.: US 6,457,308 B1
(45) Date of Patent: Oct. 1, 2002

(54) THERMAL ENERGY ENGINE ASSEMBLY

(75) Inventors: Pao Lung Lin, No. 69, Lane 99, Chin Shan Rd., Shin Lin Dist., Taipei (TW); Chun-Hsiung Han, Chungho (TW)

(73) Assignees: Polo Technology Corp., Taipei Hsien (TW); Pao Lung Lin, Taipei (TW)

( * ) Notice: Subject to any disclaimer, the term of this patent is extended or adjusted under 35 U.S.C. 154(b) by 0 days.

(21) Appl. No.: 09/987,501

(22) Filed: Nov. 15, 2001

(51) Int. Cl.[7] ..... F01B 1/00

(52) U.S. Cl. ..... 60/508; 92/31

(58) Field of Search ..... 60/508; 92/31

(56) References Cited

U.S. PATENT DOCUMENTS

| | | | | | |
|---|---|---|---|---|---|
| 3,508,472 | A | * | 4/1970 | Hartwick, Jr. | 92/31 X |
| 3,530,769 | A | * | 9/1970 | Gurevich | 92/31 |
| 3,901,034 | A | * | 8/1975 | Munzinger | 60/519 |
| 5,241,895 | A | * | 9/1993 | Weyer | 92/31 X |

* cited by examiner

*Primary Examiner*—Hoang Nguyen
(74) *Attorney, Agent, or Firm*—Rosenberg, Klein & Lee

(57) ABSTRACT

A thermal energy engine assembly comprises a cylinder, a piston set, a reheater, a spindle and a flywheel. An external thermal source is placed outside the cylinder to drive the piston set to have reciprocating motion along the spindle. The piston set has at least one groove on outer surface thereof and the flywheel has a rotatory motion guided by the groove. The reheater is arranged within the cylinder and used to accumulate thermal energy to enhance efficiency of the thermal energy engine assembly.

9 Claims, 6 Drawing Sheets

THERMAL ENERGY ENGINE ASSEMBLY

FIELD OF THE INVENTION

The present invention relates to a thermal energy engine assembly, especially to a power machinery for a thermal energy engine operated in principle of temperature difference and having groove on outer surface of a piston set thereof to drive a flywheel in rotatory motion.

BACKGROUND OF THE INVENTION

There are many kinds of commercially available engines now. For example, a reciprocating piston engine utilizes crankshaft to convert reciprocating linear motion to rotational flywheel motion. The reciprocating piston engine has advantages of robust and smooth operation.

In above-mentioned reciprocating piston engine, the crankshaft has vibration problem due to bias loading thereof. Therefore, the crankshaft should be used with balance weight to reduce vibration. However, the reciprocating piston engine becomes bulky and complicated.

SUMMARY OF THE INVENTION

It is an object of the present invention to provide a thermal energy engine assembly operated in principle of temperature difference and not using crankshaft.

It is another object of the present invention to provide a thermal energy engine assembly, which drives the piston in reciprocating way in a cylinder by the principle of temperature difference.

To achieve above object, the present invention provides a thermal energy engine assembly comprising a cylinder, a piston set having at least one groove and arranged within the cylinder, a reheater through which an air in the cylinder ventilating, a spindle within the cylinder and passing through the piston set and a flywheel fit on the groove. The flywheel has a rotatory motion as the piston set has reciprocating motion along the spindle by expansion and shrunk of air in the cylinder due to temperature variation.

The various objects and advantages of the present invention will be more readily understood from the following detailed description when read in conjunction with the appended drawing, in which:

DETAILED DESCRIPTION OF THE INVENTION

Figure 1:
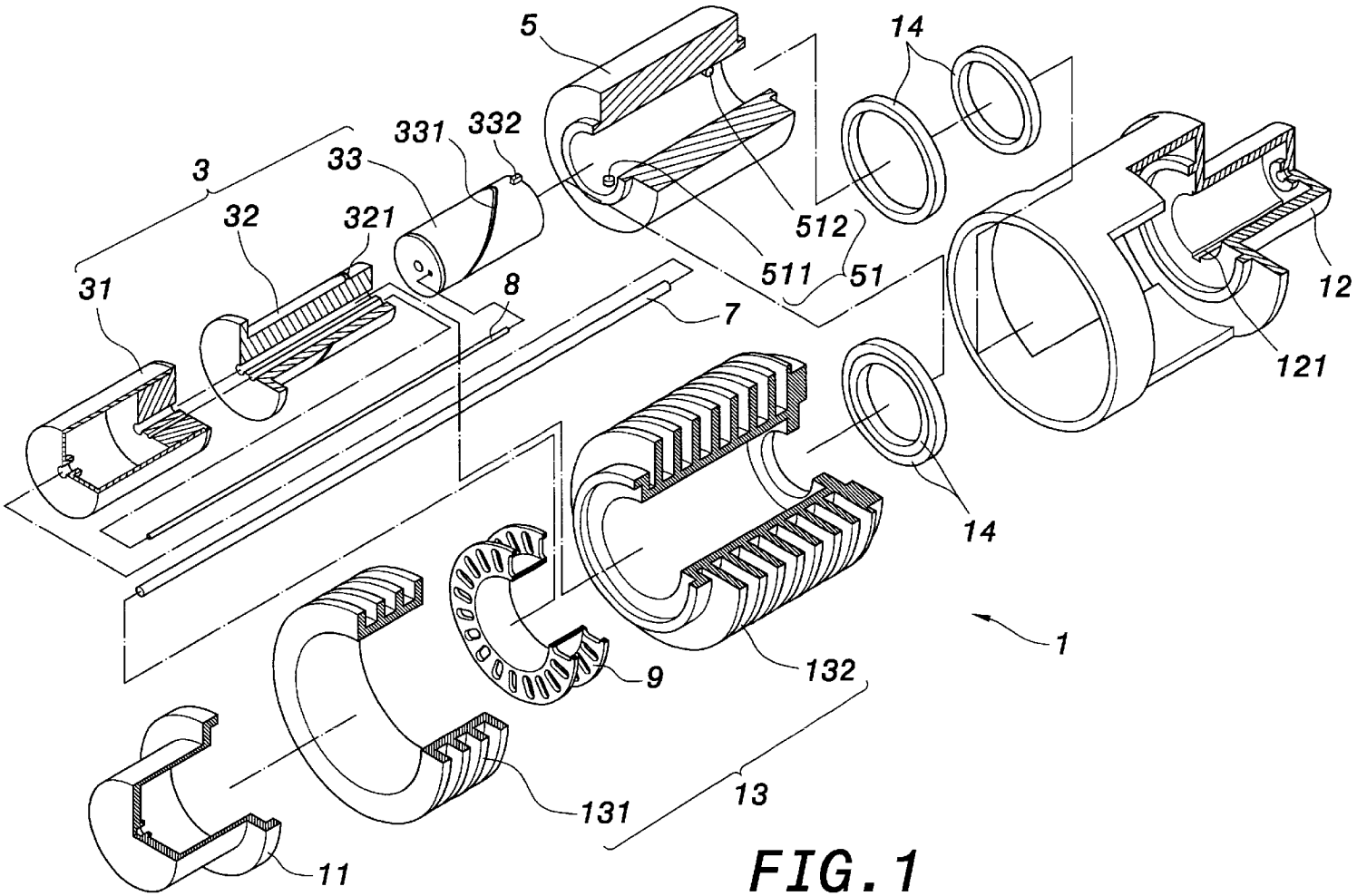
FIG. 1 shows an exploded view of the present invention.
Figure 2:
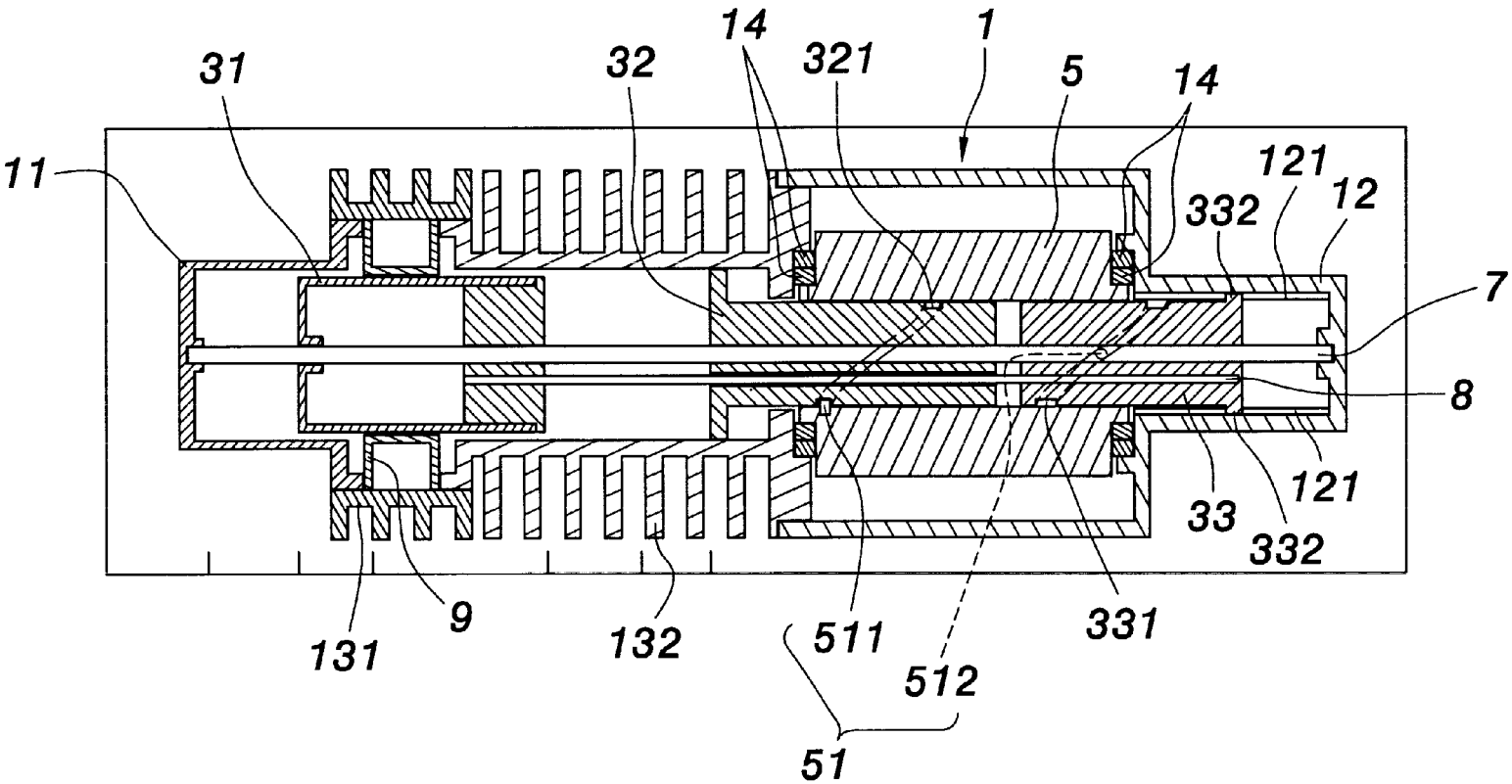
FIG. 2 shows a sectional view of the present invention.

FIGS. 1 and 2 shows am exploded view and a sectional of the present invention. The present invention provides a thermal energy engine assembly comprising a cylinder 1, a piston set 3, a flywheel 5, a spindle 7 and a reheater 9.

The piston set 3 is arranged in the cylinder 1 and comprises a first valving piston 31, a power piston 32, and a second valving piston 33. The power piston 32 and the second valving piston 33 have spiral grooves 321 and 331, respectively, on outer surface thereof. The spindle 7 in turn passes through the first valving piston 31, the power piston 32, and the second valving piston 33 such that the first valving piston 31, the power piston 32, and the second valving piston 33 have reciprocating movement along the spindle 7.

A countershaft 8 is connected to the first valving piston 31 and the second valving piston 33 through the power piston 32 such that the first valving piston 31 and the second valving piston 33 have a fixed separation therebetween. The flywheel 5 is slidably fit on the spiral grooves 321 and 323 through a sliding member 51. The sliding member 51 is arranged on the inner wall of the flywheel 5 and is composed of a first bump 511 and a second bump 512. More particularly, the first bump 511 is slidably fit on the spiral groove 321 of the power piston 32, and the second bump 512 is slidably fit on the spiral groove 321 of the second valving piston 33. The second valving piston 33 is provided with a guiding block 332 to prevent the rotation of the second valving piston 33 on the spindle 7.

The cylinder 1 comprises a front barrel 11, a rear barrel 12 and a heat radiator 13. The front barrel 11 is used to receive heat from an external thermal source (not shown) and the rear barrel 75 is used to receive the flywheel 5. The heat radiator 13 is arranged between the front barrel 11 and the rear barrel 12 and composed of a first heat radiating section 131 and a second heat radiating section 132 to provide heat radiation function for the cylinder 1. The reheated 9 is arranged within the cylinder 1 and used to accumulate thermal energy to enhance efficiency of the cylinder 1. Moreover a plurality of rings 14 are arranged within the cylinder 1 and used to reduce the friction of the flywheel 5.

The spindle 7 passes through the first valving piston 31, the power piston 32, and the second valving piston 33 and the frond end and the rear end thereof further extrude into inner wall of the front barrel 11 and the rear barrel 12, respectively. The rear barrel 12 has a guiding slot 121 in which the guiding block 332 of the second valving piston 33 slides.

When the first valving piston 31, the power piston 32, and the second valving piston 33 have reciprocating movement along the spindle 7, the first bump 511 and the second bump 512 of the flywheel 5 are moved along the spiral grooves 321 and 331. Therefore, the flywheel 5 has rotatory motion.

For normal operation of the cylinder 1, an external thermal source (not shown) is provided outside the front barrel 11 and the operation inside the cylinder 1 is described below.

Figure 3:
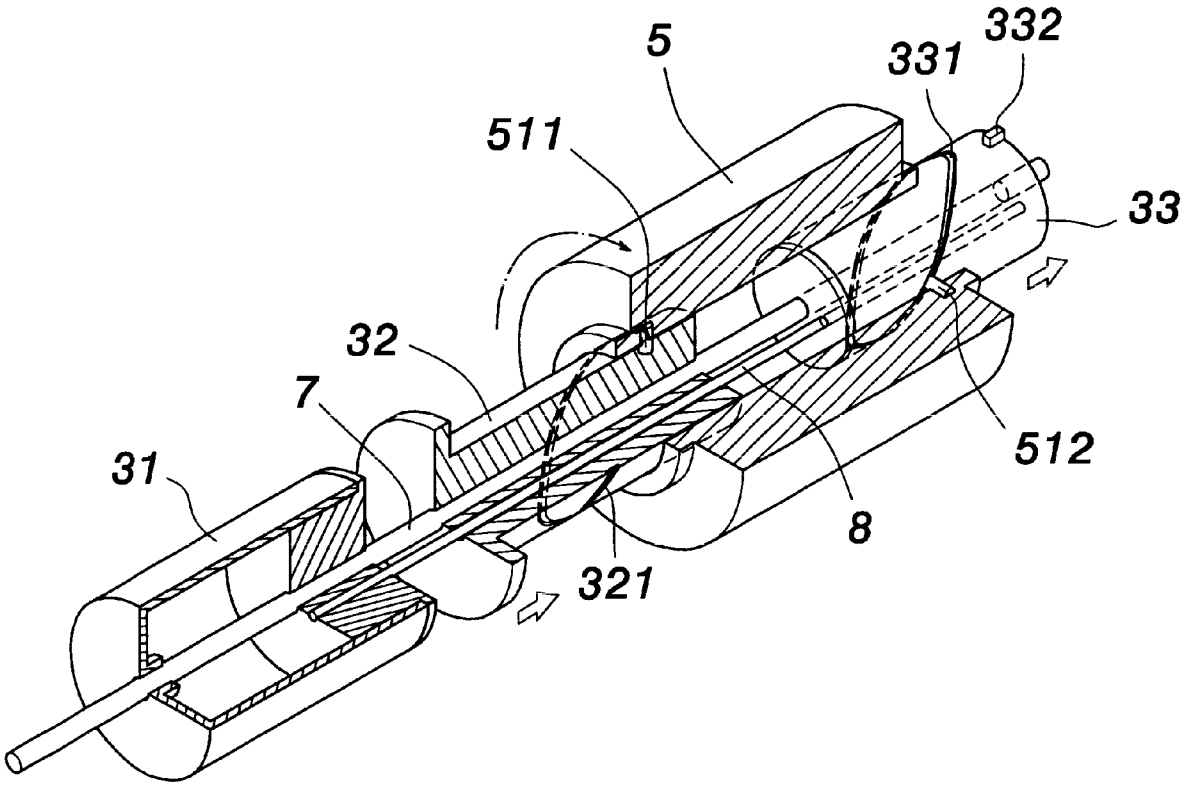
FIG. 3 shows the thermal energy engine assembly of the present invention in a first operation state.

FIG. 3 shows the thermal energy engine assembly of the present invention in a first operation state. When the front barrel 11 is heated at front side thereof, the air at front side of the front barrel 11 is also heated to expand. The first valving piston 31 is pushed to move backward along the spindle 7. The second valving piston 33 is also moved backward along the spindle 7 due to the linkage of the countershaft 8 between the first valving piston 31 and the second valving piston 33. The spiral groove 331 on the second valving piston 33 drives the second bump 512 of the flywheel 5 to rotate the flywheel 5 in clockwise direction to a position of quarter turn.

Figure 4:
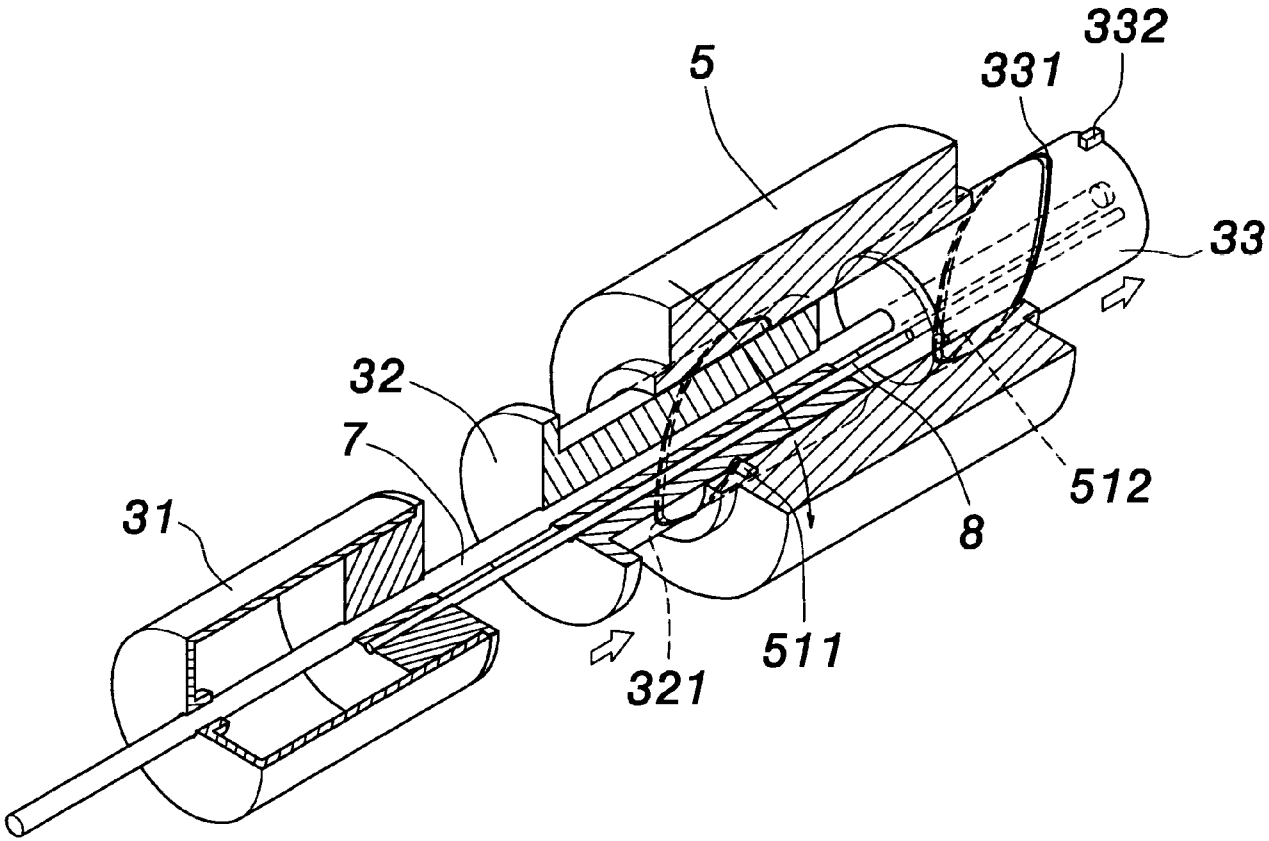
FIG. 4 shows the thermal energy engine assembly of the present invention in a second operation state.

FIG. 4 shows the thermal energy engine assembly of the present invention in second operation state. When heated air in the front barrel 11 begins to flow to a region between the first valving piston 31 and the power piston 32 through the reheater 9, the heated air in this region pushes backward the power piston 32. The spiral groove 321 on the power piston 32 drives the first bump 511 of the flywheel 5 to rotate the flywheel 5 in clockwise direction to a position of two-quarter turn.

Figure 5:
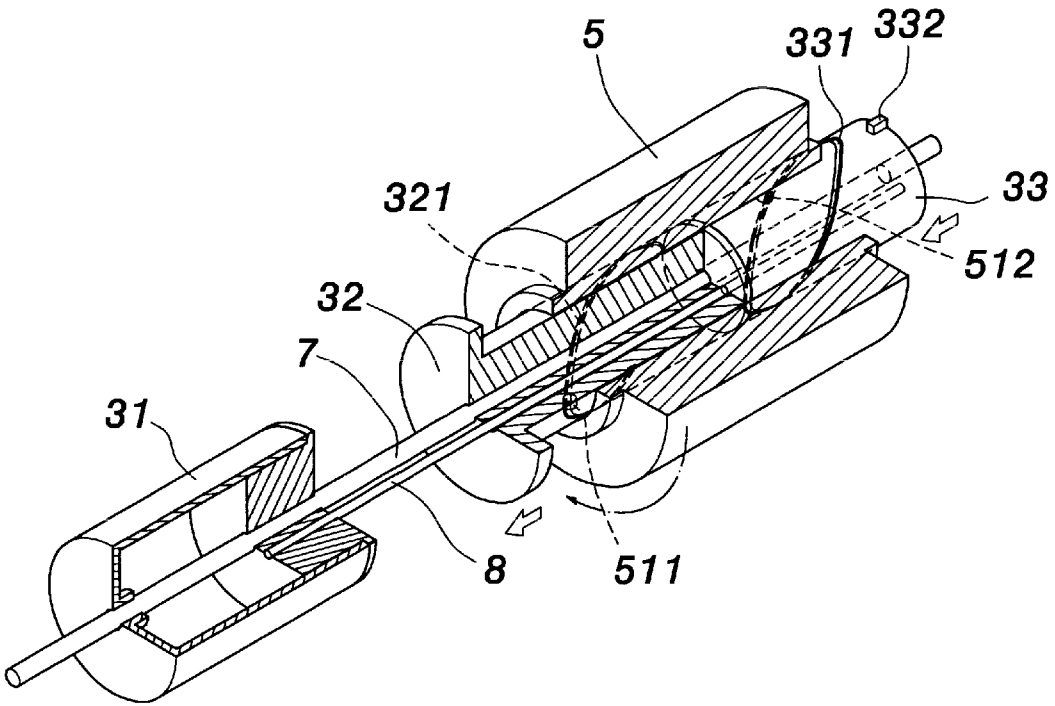
FIG. 5 shows the thermal energy engine assembly of the present invention in a third operation state.

FIG. 5 shows the thermal energy engine assembly of the present invention in a third operation state. When most of the heated air in the front barrel 11 flows to the region between the first valving piston 31 and the power piston 32 through the reheater 9, the heated air begins to pushes forward the first valving piston 31 and the second valving piston 33 is also moved forward at this time. Moreover, the heated air between the first valving piston 31 and the power piston 32 is cooled by the first heat radiating section 131 and the second heat radiating section 132 such that the volume of the heated air between the first valving piston 31 and the power piston 32 is reduced. As a result, the backward pushing force on the power piston 32 is also decreased and the first valving piston 31 and the power piston 32 keep moving forward. The spiral groove 321 on the power piston 32 and the spiral groove 331 on the second valving piston 33 drive the first bump 511 and the second bump 512 of the flywheel 5 to rotate the flywheel 5 in clockwise direction to a position of third-quarter turn.

Figure 6:
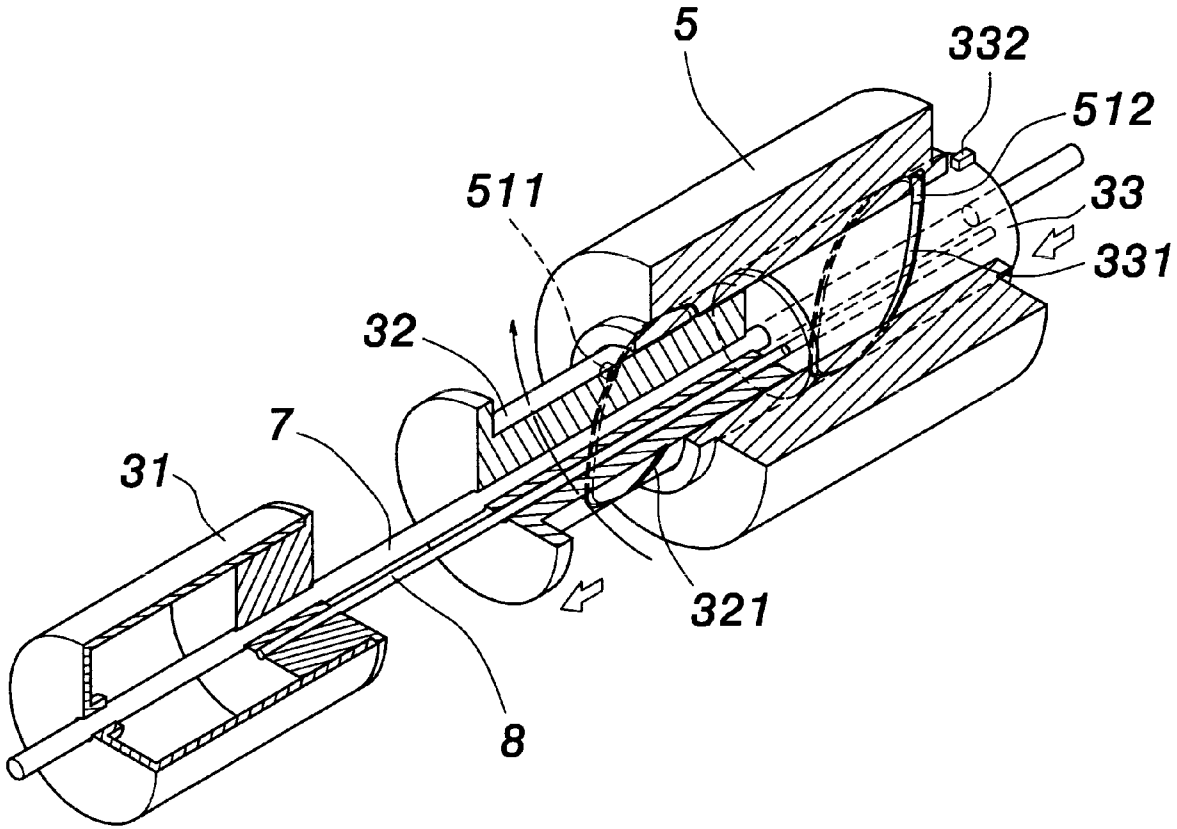
FIG. 6 shows the thermal energy engine assembly of the present invention in a fourth operation state.

FIG. 6 shows the thermal energy engine assembly of the present invention in a fourth operation state. The air between the first valving piston 31 and the power piston 32 is further cooled by the first heat radiating section 131 and the second heat radiating section 132 such that the volume of the heated air between the first valving piston 31 and the power piston 32 is greatly reduced. As a result, the backward pushing force on the power piston 32 is also decreased and the power piston 32 keeps moving forward. The spiral groove 321 on the power piston 32 drives the first bump 511 of the flywheel 5 to rotate the flywheel 5 in clockwise direction to origin position. Afterward, the air in the front barrel 11 is again heated to bring the power machinery of the present invention to the first operation state as shown in FIG. 3.

In the present invention, a stable external thermal source is provided outside the front barrel 11 such that the pistons in the cylinder 1 have reciprocating motion. The spiral groove 321 on the power piston 32 and the spiral groove 331 on the second valving piston 33 drive the first bump 511 and the second bump 512 of the flywheel 5 to rotate the flywheel 5. Moreover, the flywheel 5 can be made of magnetic material and coils are provided around the flywheel 5 such that the cylinder 1 is used as an induction generator. Moreover, the first bump 511 and the second bump 512 of the flywheel 5 are staggered by 90° with respect to the spindle 7, thus ensuring the flywheel 5 to fly in uni-direction.

To sum up, the power machinery for a thermal energy engine according to the present invention has following features:

(1) The piston is operated in principle of temperature difference.

(2) The piston has spiral grooves on outer surface thereof to convert reciprocating linear motion of the piston to rotational motion of the flywheel.

(3) The present invention uses a stable thermal source as power source.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A thermal energy engine assembly comprising a cylinder;

a piston set having at least one groove and arranged within the cylinder;

a reheater through which an air in the cylinder ventilating;

a spindle passing through the piston set;

a flywheel being fit on the groove wherein the flywheel has a rotatory motion as the piston set has reciprocating motion along the spindle.

2. The thermal energy engine assembly as in claim 1, wherein the cylinder comprises a front barrel for receiving heat from an external thermal source, a rear barrel for receiving the flywheel and a heat radiator arranged between the front barrel and the rear barrel.

3. The thermal energy engine assembly as in claim 2, wherein the heat radiator comprises a first heat radiating section and a second heat radiating section.

4. The thermal energy engine assembly as in claim 2, wherein the rear barrel has a guiding slot therein.

5. The thermal energy engine assembly as in claim 1, wherein the piston set comprises a first valving piston, a power piston and a second valving piston in turn assembled along the spindle.

6. The thermal energy engine assembly as in claim 5, wherein the grooves are arranged on an outer surface of the power piston and an outer surface of the second valving piston.

7. The thermal energy engine assembly as in claim 5, wherein a countershaft is provided between the first valving piston and the second valving to keep a fixed separation between the first valving piston and the second valving.

8. The thermal energy engine assembly as in claim 1, wherein the flywheel is fit on the groove through a sliding member.

9. The thermal energy engine assembly as in claim 1, wherein the flywheel is made of magnetic material and provided with coil to function as induction generator.

* * * * *